US008205348B2

(12) United States Patent
Baros et al.

(10) Patent No.: US 8,205,348 B2
(45) Date of Patent: Jun. 26, 2012

(54) TILE SPACER AND HOLDER THEREFOR

(75) Inventors: Davor Baros, Vancouver (CA); David John Higgs, Vancouver (CA)

(73) Assignee: Zashiki-Warashi Manufacturing Inc., Vancouver (CA)

( * ) Notice: Subject to any disclaimer, the term of this patent is extended or adjusted under 35 U.S.C. 154(b) by 295 days.

(21) Appl. No.: 12/637,668

(22) Filed: Dec. 14, 2009

(65) Prior Publication Data

US 2010/0088912 A1 Apr. 15, 2010

Related U.S. Application Data

(63) Continuation-in-part of application No. 12/051,711, filed on Mar. 19, 2008, now Pat. No. 7,698,831.

(51) Int. Cl.
*E04F 21/18* (2006.01)
*E04F 21/20* (2006.01)

(52) U.S. Cl. ..... 33/526; 33/DIG. 20

(58) Field of Classification Search ..... 33/526, 33/527, DIG. 20
See application file for complete search history.

(56) References Cited

U.S. PATENT DOCUMENTS

| | | | |
|---|---|---|---|
| 1,590,172 | A | 6/1926 | Thorberg |
| 2,031,684 | A | 2/1936 | Berger |
| 2,836,055 | A | 5/1958 | Shuman |
| 2,940,264 | A | 6/1960 | Harper et al. |
| 3,010,213 | A | 11/1961 | Rodtz, Sr. |
| 4,503,654 | A | 3/1985 | Cosentino |
| 4,793,068 | A | 12/1988 | Golkar |
| 4,953,341 | A | 9/1990 | Joos |
| 5,010,654 | A | 4/1991 | Funes, Jr. |
| 5,191,718 | A | 3/1993 | Fox |
| D337,247 | S | 7/1993 | Dart |
| 5,288,534 | A | 2/1994 | Tavshanjian |
| 5,359,783 | A | 11/1994 | Smith |
| 5,623,799 | A | 4/1997 | Kowalski et al. |
| 5,743,391 | A | 4/1998 | Hsiao |
| 6,354,058 | B1 | 3/2002 | Lewis |

(Continued)

FOREIGN PATENT DOCUMENTS

CA 2599991 A1 3/2009

(Continued)

OTHER PUBLICATIONS

Advertisement titled "tilejax™ The revolutionary tile spacer", The Official Daily Publication of the National Hardware Show Wednesday Daily, made public on May 7, 2008, p. 22.

(Continued)

*Primary Examiner* — R. A. Smith
(74) *Attorney, Agent, or Firm* — Cameron IP

(57) ABSTRACT

The present invention relates to a removable tile spacer for enabling even spacing between a first tile and a second tile that are perpendicular to each other. The second tile has an end opposite the first tile. The removable tile spacer includes a first elongate member interposable between the first tile and the end of the second tile to provide spacing between the first tile and the second tile. The tile spacer includes a body. The first elongate member is connected to and extends away from the body at an angle relative to the body such that the body has at least a portion which is spaced-apart from both the first tile and the second tile when the first elongate member is interposed between the first tile and the end of the second tile. This thereby facilitates removal of the tile spacer when tile spacing is completed.

17 Claims, 14 Drawing Sheets

U.S. PATENT DOCUMENTS

| | | | |
|---|---|---|---|
| 6,394,518 | B1 | 5/2002 | Kelley |
| 6,612,045 | B2 | 9/2003 | Kruskamp |
| 6,647,685 | B2 | 11/2003 | Annarella et al. |
| D492,210 | S | 6/2004 | Shilo et al. |
| 6,769,191 | B1 | 8/2004 | Zusman |
| 6,823,640 | B1 | 11/2004 | Pytlewski |
| 6,874,242 | B2 | 4/2005 | Shilo et al. |
| 7,093,714 | B2 | 8/2006 | Huang |
| 7,475,488 | B2 | 1/2009 | Symington |
| 7,536,802 | B1 | 5/2009 | Tavy et al. |
| 2002/0121027 | A1 | 9/2002 | Kruskamp |
| 2003/0226271 | A1 | 12/2003 | Cordell |
| 2004/0060184 | A1 | 4/2004 | Shilo et al. |
| 2004/0250435 | A1 | 12/2004 | Fiore |
| 2005/0214502 | A1 | 9/2005 | Westthorp |
| 2005/0257468 | A1 | 11/2005 | Serros et al. |
| 2007/0011898 | A1 | 1/2007 | Frank et al. |
| 2007/0022693 | A1 | 2/2007 | Ran |
| 2007/0227025 | A1 | 10/2007 | Venture |

FOREIGN PATENT DOCUMENTS

| | | | |
|---|---|---|---|
| EP | 258108 | A1 | 3/1988 |
| EP | 1577460 | A2 | 9/2005 |
| GB | 2331322 | | 5/1999 |
| WO | WO03/033837 | | 4/2003 |
| WO | WO2004/001159 | A1 | 12/2003 |
| WO | WO2006/072772 | A2 | 7/2006 |
| WO | WO2006/075180 | | 7/2006 |

OTHER PUBLICATIONS

Advertisement titled "Tile Wedge Spacers, for Alignment and Spacing of Wall Tiles, 500 Pieces Per Bulk Pack" as provided on Sep. 24, 2009 from Bob Vila's SmartBuys website, 2 pages.

TILE SPACER AND HOLDER THEREFOR

CROSS REFERENCE TO RELATED APPLICATION

This application is a continuation-in-part of U.S. application Ser. No. 12/051,711, filed on Mar. 19, 2008 now U.S. Pat. No. 7,698,831 and entitled TILE SPACER AND HOLDER THEREFOR, the disclosure of which is hereby incorporated by reference.

BACKGROUND OF THE INVENTION

The present invention relates to tile spacers. More particularly, it relates to tile spacers used for locating tiles in an evenly spaced-apart manner before the tiles are secured to a surface, so that the grout lines are even and regular.

Tiles are manufactured in differing shapes, sizes and thicknesses. The arrangement of tiles is often a matter of individual taste, artistic interpretation and ability.

The most common and readily available tile spacers in general hardware stores and specialty tile supply outlets are illustrated by numeral 10 in FIG. 1. The tile spacers 10 have either a cross-shape configuration 12 or a T-shaped configuration 14 configuration. The tile spacers 10 suffer a disadvantage in that they are often left within the grout. This results in the tile spacers 10 not being reused, which is thus more wasteful and expensive for a user. In the alternative, the tile spacers 10 are removed, but with great difficulty.

Moreover, the tile spacers 10 of the prior art are restricted to tiles requiring square or brick patterns when laid flat at tile intersection points during the installation process. Accordingly, the tile spacers 10 have significant limitations in terms of the variety of tile patterns with which they can function.

In order to be used in different configurations, the spacers in FIG. 1 can be inserted with ends 13 in first. This however significantly increases the number of spacers required per installation as two spacers are required per edge.

International Patent Application Number PCT/GB2006/000132 to Skillings illustrates a tile spacer that enables the setting of a variety of tile patterns. However, Skillings suffers a number of disadvantages including being unable to provide spacing for all corner configurations.

Also, the tile spacers of prior art such as that described by Skillings may touch and obstruct visibility of the front face of the tile. As a result, these tile spacers are shaped such that adhesive build up is difficult if not impossible at times to identify.

Excessive adhesive tends to hide in tile corner areas. This causes further difficulty for the installer in identifying excess adhesive or adhesive that transfers or squeezes up on to the surface of the tile. This is an even more significant problem if the tile has a porous nature, such as clay tile, terracotta tile, natural stone tile, and satin finished tile. Moreover, such adhesive is difficult if not impossible to clean up under the area of this type tile spacer.

Accordingly, there is a need for a tile spacer that overcomes the above disadvantages.

A further drawback of the prior art concerns the ability to provide the user with a ready supply of adhesives, tools, tiles spacers, and cleaning equipment. Traditional tiles spacers are provided in plastic bags. Often piles of materials are staged at certain locations for ready access. These bags will move with the user either in their pocket or hands. However, when sitting, kneeling or crouching during typical floor tiling operations, this is cumbersome, tying up the hands. The interiors of the pockets are also extremely frustrating to access. This is particularly true if the user has gloves with the gloved hand picking up a small piece of plastic from a flat surface or from a deep pocket. Also, staging piles of tile spacers or bags in a general location results in tile spacers quickly becoming out of reach. This is especially true in vertical wall tiling operations.

BRIEF SUMMARY OF INVENTION

The present invention provides a tile spacer and tiling tool that overcome the above disadvantages. It is an object of the present invention to provide an improved tile spacer and an improved tiling tool.

It is a further general aim of the invention to provide a removable tile spacer that reduces the time consuming laborious nature of the task of tile installation with a tile spacer that can be used with ease by a skilled worker or an amateur equally.

The present invention provides a solution over the prior art in the form of an improved removable tile spacer that enables the setting of a greater variety of tile patterns in a greater variety of locations, that is reusable, that promotes visual inspection of and access to underlying adhesive, and that is easy to handle and remove thereafter. The present invention also provides a solution in the form of a multi-purpose tiling tool for the tiling.

There is provided, according to one aspect of the invention, a removable tile spacer for enabling even spacing between a first tile and a second tile. The first tile and the second tile are perpendicular to each other. The second tile has an end opposite the first tile. The removable tile spacer includes a first elongate member interposable between the first tile and the end of the second tile to provide spacing between the first tile and the second tile. The tile spacer includes a body. The first elongate member is connected to and extends away from the body at an angle relative to the body such that the body has at least a portion which is spaced-apart from both the first tile and the second tile when the first elongate member is interposed between the first tile and the end of the second tile. This thereby facilitates removal of the tile spacer when tile spacing is completed.

There is provided, according to another aspect of the invention, the above described tile spacer in combination with the above described first tile and second tile.

According to a further aspect of the invention, there is provided a method of arranging a first tile and a second tile in a butt joint configuration. The method uses a removable tile spacer having a body and a first elongate member connected to and extending away from the body at an angle. The method includes laying down the first tile on one of a first surface and a second surface and against a corner made by the first surface and the second surface. The method includes positioning the second tile against another of the first surface and the second surface. The second tile has an end facing the first tile. The method includes interposing the first elongate member between the first tile and the end of the second tile to provide spacing between the first tile and the second tile.

According to yet a further aspect of the invention, there is provided a removable tile spacer for enabling even spacing between a first tile and a second tile. The first tile and the second tile are perpendicular to each other. The first tile has a tile face and the second tile has an end opposite the tile face. The removable tile spacer includes a body having an annular shape. The tile spacer includes a first elongate member and a second elongate member. Both members are connected to and radially extend away from the body. The first elongate member and the second elongate member are spaced-apart from each other. The first elongate member and the second elongate member are arranged to simultaneously abut between both the tile face of the first tile and the end of the second tile to provide even spacing between the first tile and the second tile.

BRIEF DESCRIPTION OF DRAWINGS

The invention will be more readily understood from the following description of preferred embodiments thereof given, by way of example only, with reference to the accompanying drawings, in which.

DESCRIPTION OF THE PREFERRED EMBODIMENTS

Figure 1:
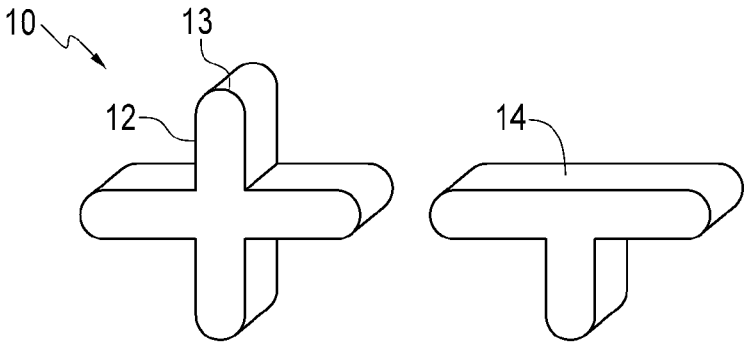
FIG. 1 (Prior Art)
FIG. 1 is a top perspective view of tile spacers according to the prior art.
Figure 2:
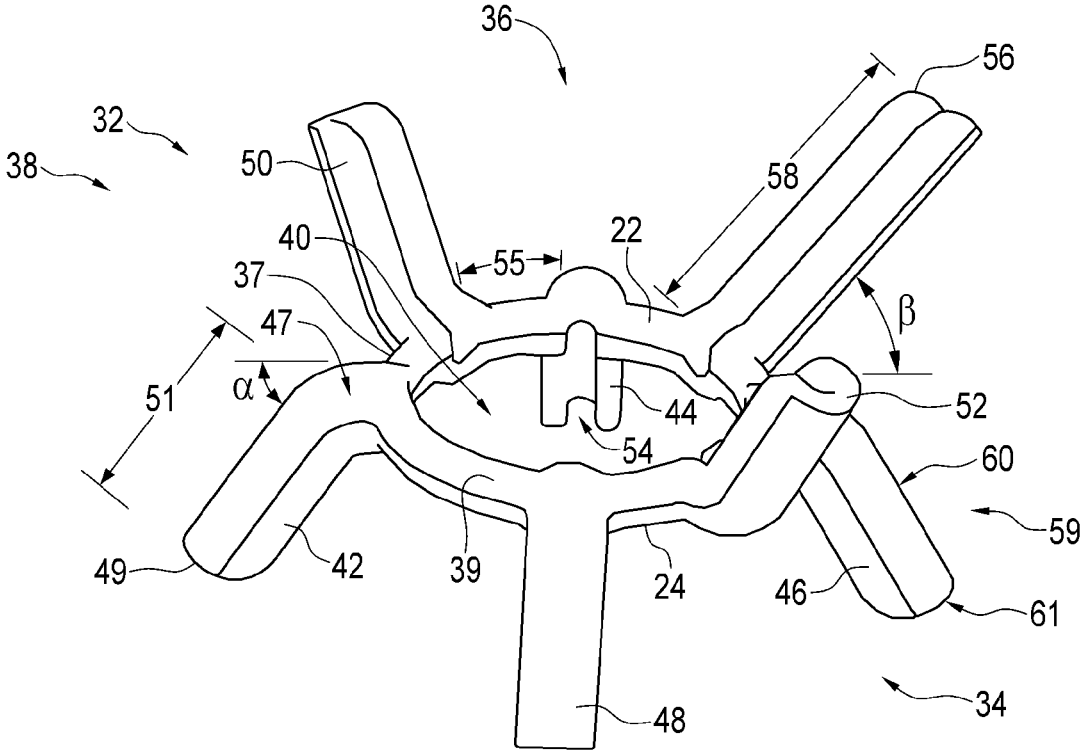
FIG. 2 is an isometric view of the removable tile spacer according to one aspect of the present invention.

Referring to FIG. 2, a removable tile spacer 32 is illustrated according to one embodiment of the invention. The tile spacer 32 has a first side 34 and a second side 36 opposite the first side 34. The tile spacer 32 includes a connecting member or body 37 which in this example is in the form of an annulus with an aperture 40. The body 37 has a first face 22 and a second face 24 opposite the first face.

The tile spacer 32 includes a plurality of elongate members extending from the body 37 including a first elongate member 42, a second elongate member 44, a third elongate member 46, and a fourth elongate member 48 which all are radially spaced-apart and which extend toward the first side 34 of the tile spacer 32. Each of the elongate members is flexible in this example and has a proximal end connected to the body 37, for example proximal end 47 of member 42, and a distal end, for example distal end 49 of member 42. The distal ends of the members 42, 44, 46 and 48 define a first plane which in this example is parallel with the body 37.

The plurality of elongate members also include a fifth elongate member 50, a sixth elongate member 52, and a seventh elongate number 56 which extend toward the second side 36 of the spacer. In other words, they are on the opposite side of the tile spacer compared to the members 42, 44, 46 and 48. The sixth member 52 in this example is opposite the fifth member 50 and is angularly space-apart 180 degrees therefrom about the body 37. In this example, the fifth member 50 is between the first member 42 and the second member 44, and the sixth member 52 is between the third member 46 and the fourth member 48.

The first member 42, the second member 44, the third member 46, the fourth member 48, the fifth member 50 and the sixth member 52 are labelled as such only for the sake of ease of description, are all similar in shape and size in this example, and are spaced-apart angularly about the body 37. Accordingly, only the first member 42 will be described in detail.

Figure 3:
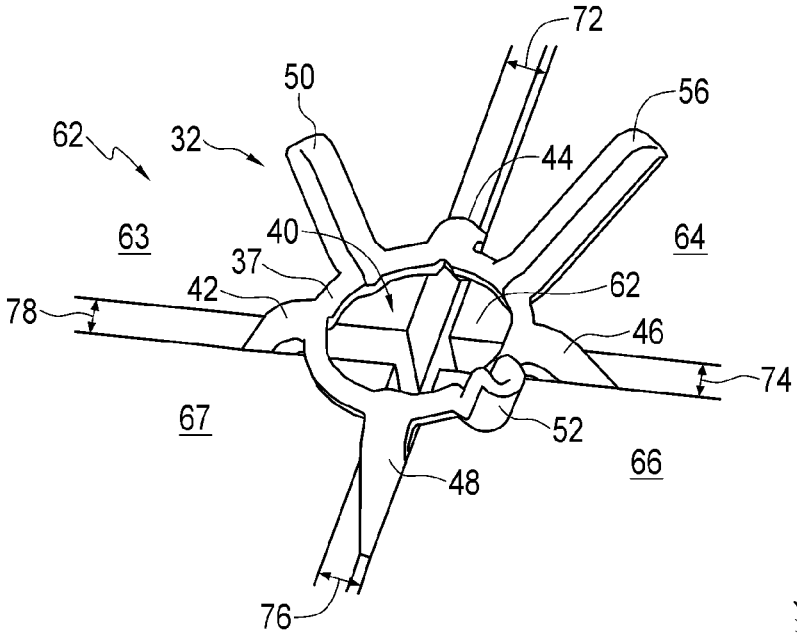
FIG. 3 is an isometric view of the tile spacer of FIG. 2 interposed between tiles arranged in a four tile cross-shape pattern.
Figure 3A:
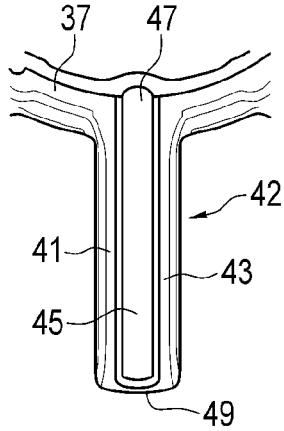
FIG. 3*a* is an inverted, partially broken away view of an elongate member according to the embodiment of the tile spacer shown in FIG. 2.
Figure 4:
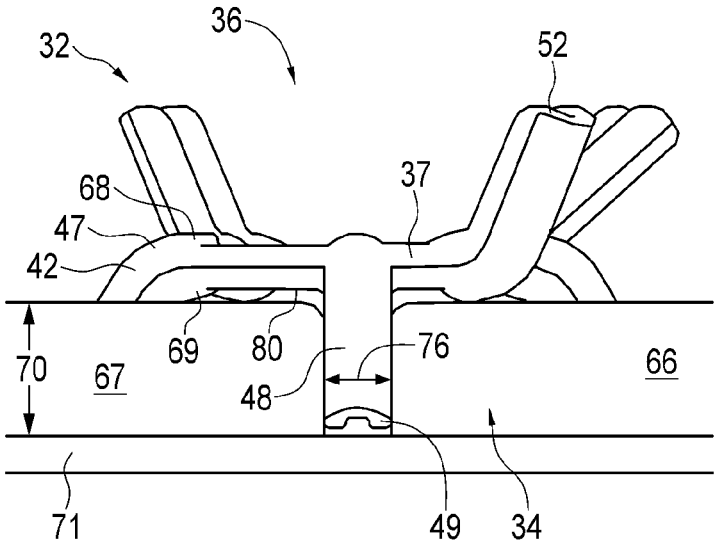
FIG. 4 is a front elevation view of the tile spacer and tiles of FIG. 3.

Referring to FIG. 3*a*, the first member 42 is channel-shaped in this example, though this is not essential. The member has a pair of parallel flanges 41 and 43 spaced-apart by a central groove 45 that is concave in this example. The member 42 projects above the rest of body 37 towards side 36 of the spacer at ridge 68 as seen in FIG. 4. Similarly it projects below the rest of body 37 towards side 34 as seen at ridge 69 in FIG. 4.

Referring back to FIG. 2, the first member 42 has a length 51 which may be between 6 mm and 100 mm. The first member 42 radially extends away from the body 37 while also extending towards the first side 34 at an angle $\alpha$. The angle $\alpha$ may be in the range of 45 to 75 degrees, and in this example, is approximately 60 degrees. Put another way, member 42 in this example extends outwards from the connecting member or body 37 at an angle of 120 degrees relative to the connecting member. As stated, the members 44, 46 and 48 are similar. Also the members 50 and 52 in this embodiment are similar although extending towards the opposite, second side 36 of the spacer.

The seventh member 56 also extends toward the second side 36 of the tile spacer 32. The seventh member 56 is between the fifth member 50 and the sixth member 52 and is angularly spaced-apart 90 degrees from each of these members. In this example, the fifth member, the sixth member, and the seventh member all extend to distal ends that define a second plane parallel to the body 37. The seventh member 56 in this example is also between the second member 44 and the third member 46 and is similar to the first member 42 with the exception that the seventh member 56 has a length 58 which is equal to or longer than that of the first member 42 and the other members. The length 58 may be up to 1.6 times longer than member 42. In this example, the member 42 is 1.4 times the length of number 42. The seventh member 56 extends away from the body 37 radially and at an angle β. The angle β may vary provided the seventh member 56 extends toward the second side 36. The angle β may be in the range of between 25 and 60 degrees, and in this example, is approximately 32.5 degrees.

The use of the tile spacer 32 in combination with various arrangements of tiles will now be described. Referring to FIGS. 3 and 4, these illustrate the tile spacer 32 having members 42, 44, 46 and 48 interposed between four tiles to form a cross-shaped pattern 62 for grout. There is a first tile 63, a second tile 64, a third tile 66 and a fourth tile 67, all of which have a thickness 70 and which abut a substrate 71. The tile spacer 32 is positioned such that the first member 42 is interposed between and abuts both the fourth tile 67 and the first tile 63. The second member 44 is interposed between and abuts both the first tile 63 and the second tile 64. The third member 46 is interposed between and abuts both the second tile 64 and the third tile 66. The fourth member 48 is interposed between and abuts both the third tile 66 and the fourth tile 67. As a result, the tile spacer 32 is shaped to provide the cross-shaped grout pattern 62 with evenly spaced-apart gaps 72, 74, 76, and 78, which in this example are all equal. Referring to FIG. 4, the body 37 remains elevated by the ridges as exampled by ridge 69 of the first member 42 and is spaced-apart from the tiles between the ridges. The fifth member 50, sixth member 52 and the seventh member 56 extend away from the tiles and thereby allow a user to easily grip these members to remove the tile spacer 32 after grouting is complete.

Figure 5:
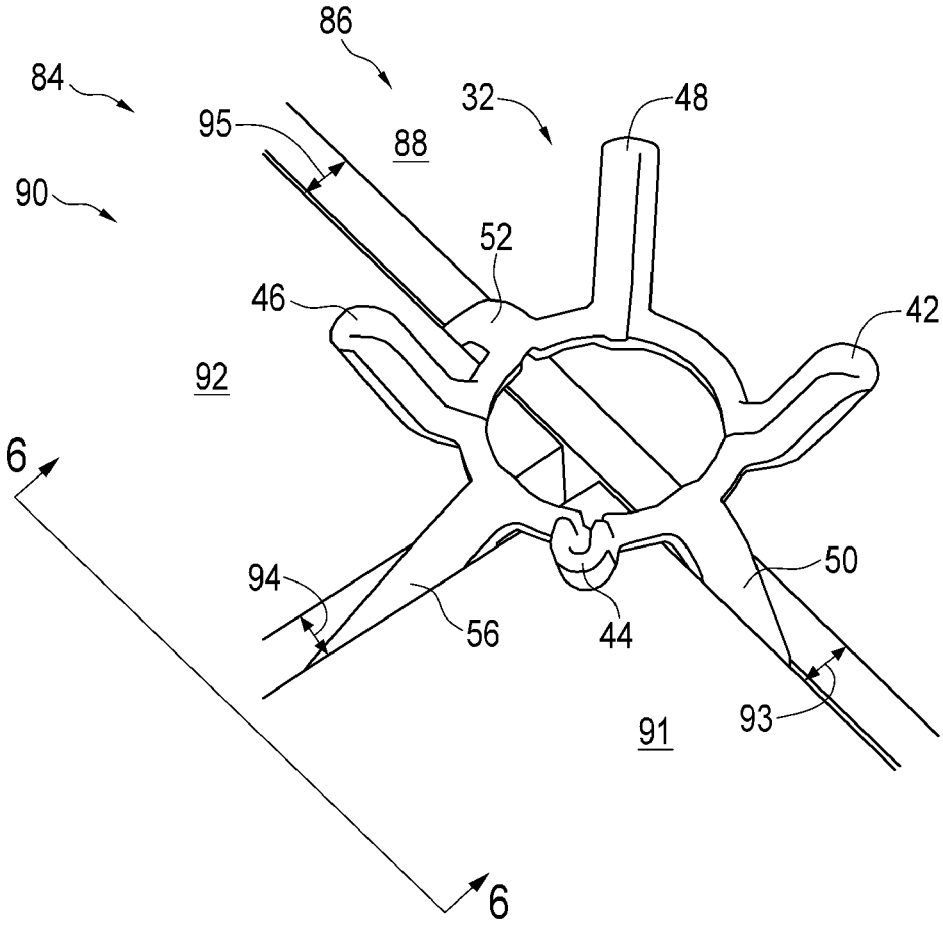
FIG. 5 is an isometric view of the tile spacer of FIG. 2 interposed between tiles arranged in a three tile T-shape pattern.
Figure 6:
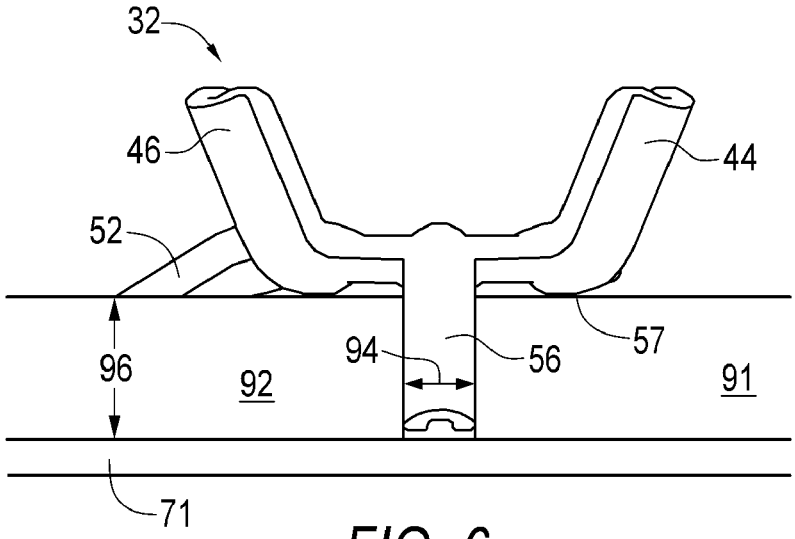
FIG. 6 is a sectional elevation view of the tile spacer and tiles along lines 6-6 of FIG. 5.

Referring now to FIGS. 5 and 6, these illustrate the tile spacer 32 having its members 50, 52 and 56 between three tiles to form a T-shape grout pattern 84. This includes a first tile 88, a second tile 91 and a third tile 92, each of which has a tile thickness 96. The tile spacer 32 is positioned such that the fifth member 50 is interposed between and abuts both the first tile 88 and the second tile 91. The seventh member 56 is interposed between and abuts both the second tile 91 and the third tile 92. The sixth member 52 is interposed between and abuts both the third tile 92 and the first tile 88. The tile spacer 32 thereby enables the three tiles requiring a T-shape grout pattern 84 to be evenly-spaced apart through gaps 93, 94, and 95, which in this example are equal in width. The first member 42, the second member 44, the third member 46 and the fourth member 48 extend away from the tiles and thereby allow a user to easily grip these members to remove the tile spacer 32 after grouting is complete.

Figure 7:
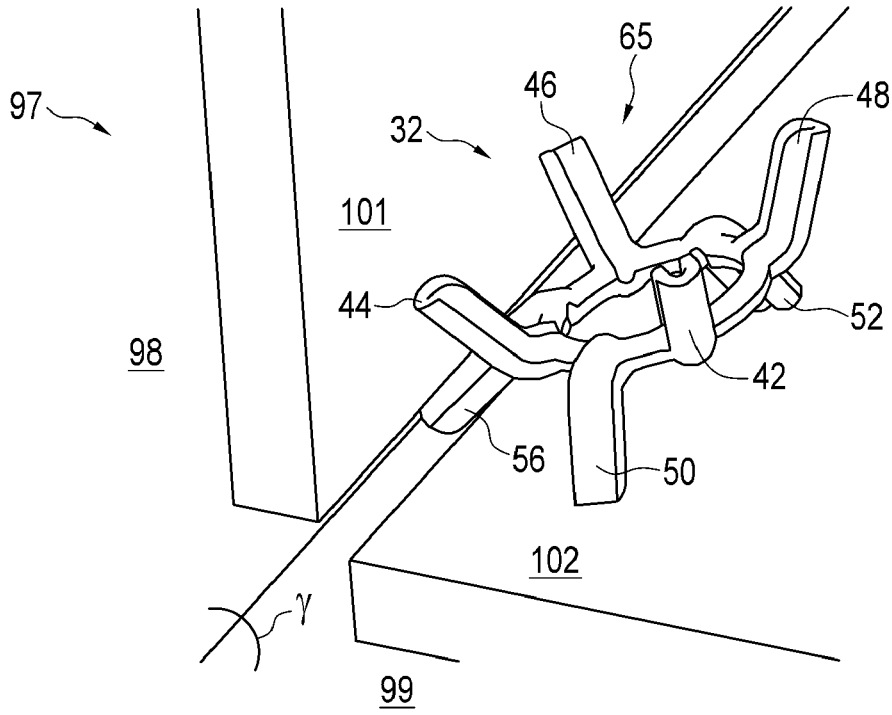
FIG. 7 is an isometric view of the tile spacer of FIG. 2 interposed between two tiles adjacent to a two-sided corner.
Figure 8:
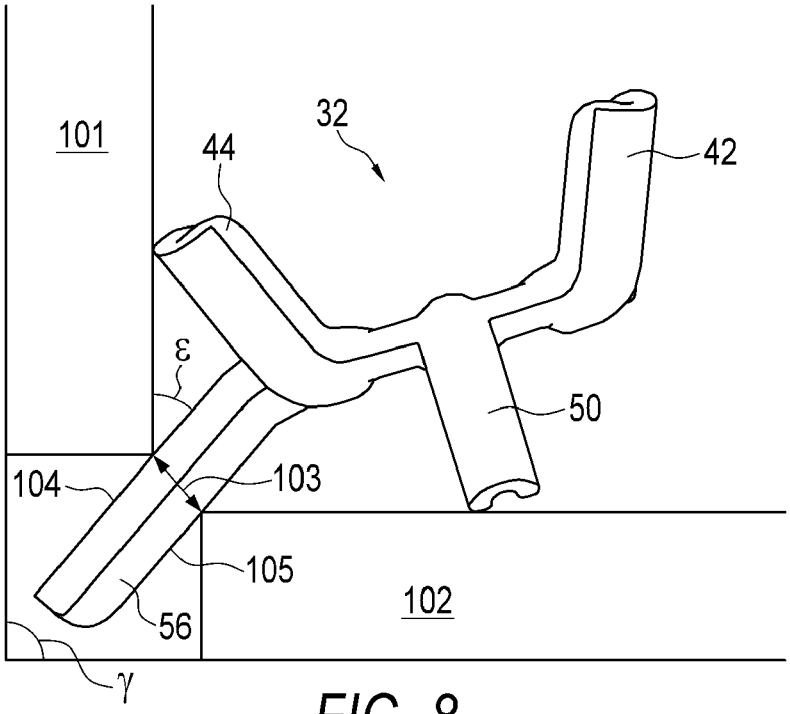
FIG. 8 is a front elevation view of the tile spacer and tiles of FIG. 7.

Referring now to FIGS. 7 and 8, the tile spacer 32 is shown as used to space tiles that meet at a two-sided corner 97 at an angle γ. This includes a first tile 101 abutting a first wall 98, and a second tile 102 abutting a second wall 99. In this example the angle γ is 90 degrees. The tile spacer 32 is positioned such that the seventh member 56 is interposed between the first tile 101 and the second tile 102. The second member 44 and the third member 46 abut the first tile 101. The fifth member 50 and the sixth member 52 abut the second tile 102. The tile spacer 32 thereby provides for evenly spaced-apart tiles that meet at a two-sided corner 97 with an even grouting gap 103.

The tile spacer 32 has members 44 and 46 on tile 101 and members 50 and 52 on tile 102 and thereby positions the seventh member 56 at an exact 45 degree angle ϵ with respect to the tiles 101 and 102. When the second member 44, the third member 46 and the seventh member 56 are all contacting the first tile 101 and when the fifth member 50, the sixth member 52 and the seventh member 56 are all contacting the second tile 102, the desired gap 103 between the first tile 101 and the second tile 102 is thereby achieved.

The first member 42 and the fourth member 48 extend away from the second tile 102, and thereby allow a user to easily grip these members to remove the tile spacer 32 after grouting is complete.

Figure 9:
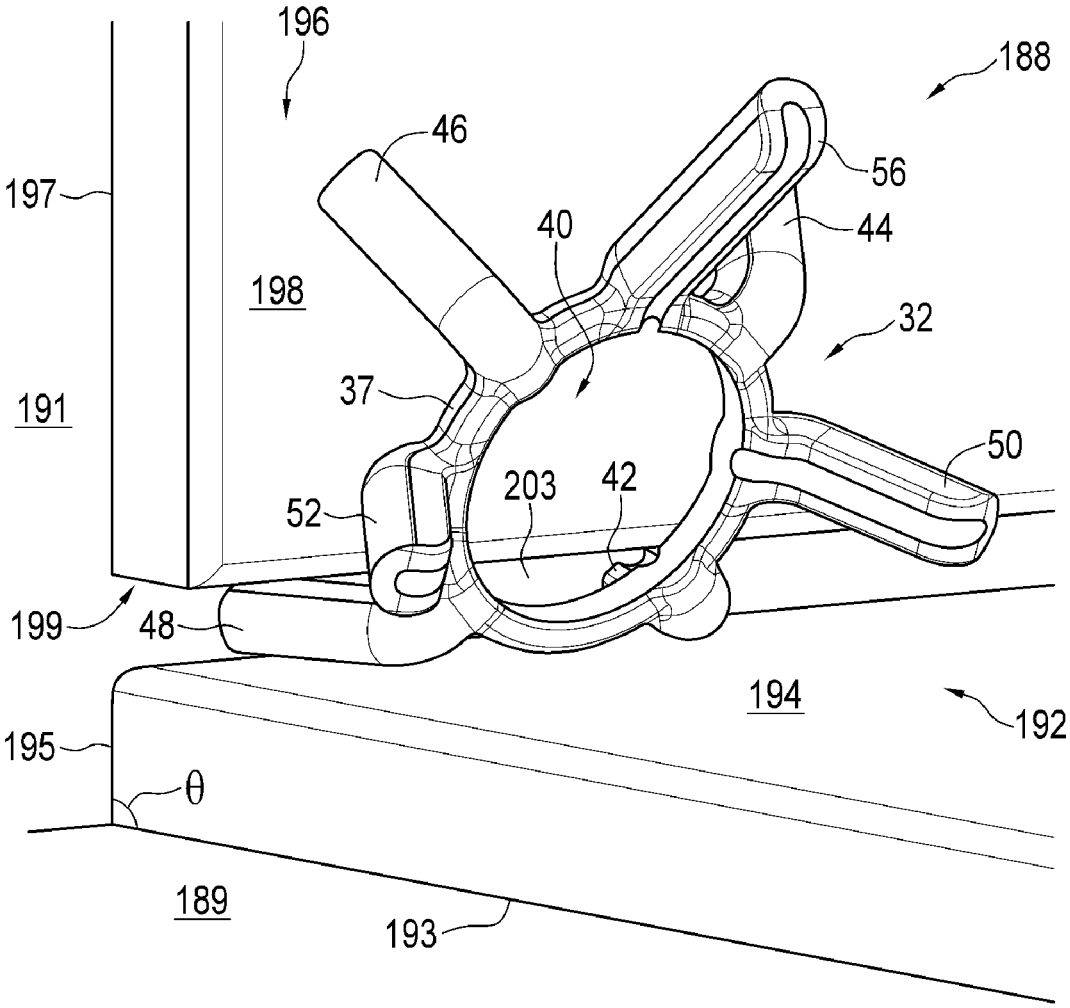
FIG. 9 is an isometric view of the tile spacer of FIG. 2 interposed between two tiles positioned in a butt joint configuration.
Figure 10:
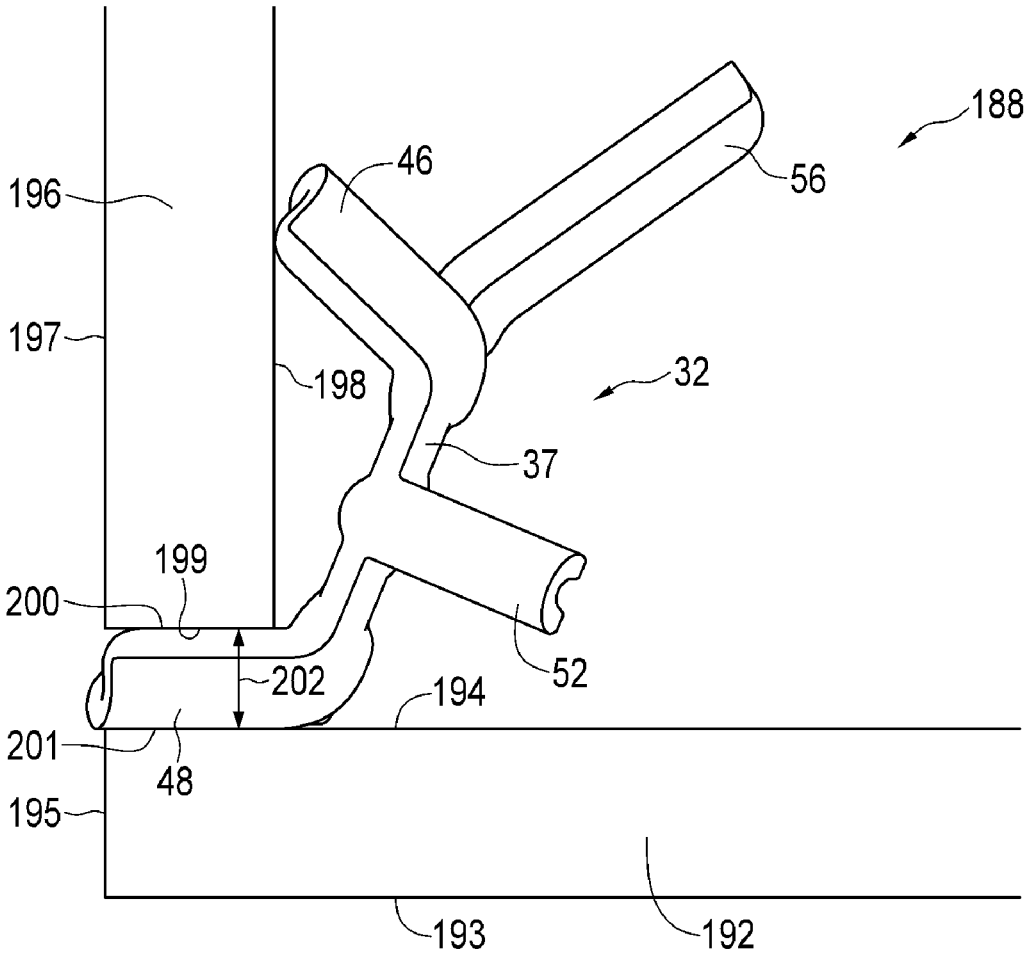
FIG. 10 is a side elevation view of the tile spacer and tiles of FIG. 9.

Referring now to FIGS. 9 and 10, the tile spacer 32 is shown between a first tile 192 and a second tile 196 positioned in a butt joint configuration. The first tile 192 has a first side 193 overlaying a first surface in this example floor 189. The first tile 192 has a second side 194 opposite the first side 193. The second side 194 faces away from the floor 189. The first tile 192 has an end 195 which in this example is perpendicular to both the first side 193 and the second side 194. The first tile 192 abuts a second surface in this example wall 191 via its end 195. Put another way, the first tile 192 in the example shown in FIGS. 9 and 10 is positioned to butt against the corner made by the floor 189 meeting the wall 191. The wall 191 extends upwards, from the perspective of FIG. 9, at an angle θ relative to the floor 189 and in this example the angle θ is 90 degrees.

The second tile 196 has a first side 197 positioned to abut the wall 191 and a second side 198 opposite the first side 197. The second side 198 faces away from the wall 191. The second tile 196 has an end 199 which in this example is perpendicular to both the first side 197 and the second side 198. The end 199 of the second tile 196 is facing the second side 194 of the first tile 192.

Elongate members 42 and 48 of the tile spacer 32 are interposed between the first tile 192 and the second tile 196 so as to provide even spacing between the tiles. This is shown in greater detail in FIG. 10 with respect to elongate member 48. Elongate member 48 has a first side 200 that abuts with end 199 of the second tile 196. In this example the first side 200 of the elongate member 48 is straight and therefore is shaped to be parallel with the end 199. Elongate member 48 has a second side 201 opposite the first side 200. The second side 201 in this example extends parallel with the first side 200. The second side 201 of the elongate member 48 abuts with the second side 194 of the first tile 192. The second side 201 of the elongate member 48 is straight and is therefore shaped to be parallel with the second side 194 of the first tile 192. The structure and positioning of elongate member 42 is similar to that of elongate member 48 and therefore will not be described.

Elongate members 42 and 48 are spaced-apart from each other as shown in FIG. 9 and extend away from the body 37 at an angle relative to the body 37 such that the body 37 has at least a portion which is spaced-apart from both the first tile 192 and the second tile 196. In this example and as best shown in FIG. 9, the entirety of the annular body 37 is so spaced-apart from the tiles 192 and 196. Elongate member 56 as a result also extends away from both the first tile 192 and the second tile 196. Thus both the body 37 and elongate member 56 provide a purchase for facilitating the removal of the tile spacer 32 when, for example, grouting between the tiles has been completed.

As best shown in FIG. 9, at least part of the annular body 37 is disposed between elongate members 42 and 48. As a result, the tile spacer 32 ensures that space 203, between the tiles 192 and 196 and between the elongate members 42 and 48, is readily accessible and visible for the application of grouting thereto.

In this example elongate members 44 and 46 abut the second tile 196. The elongate members 44 and 46 thus may increase the stability of the tile spacer 32 as a whole. This increased stability may further inhibit the tile spacer 32 from moving or becoming dislodged during the tiling process involving this specific butt joint configuration. In this way the tile spacer 32 thus helps ensure that the tiles 192 and 196 remain in their desired position.

Figure 11:
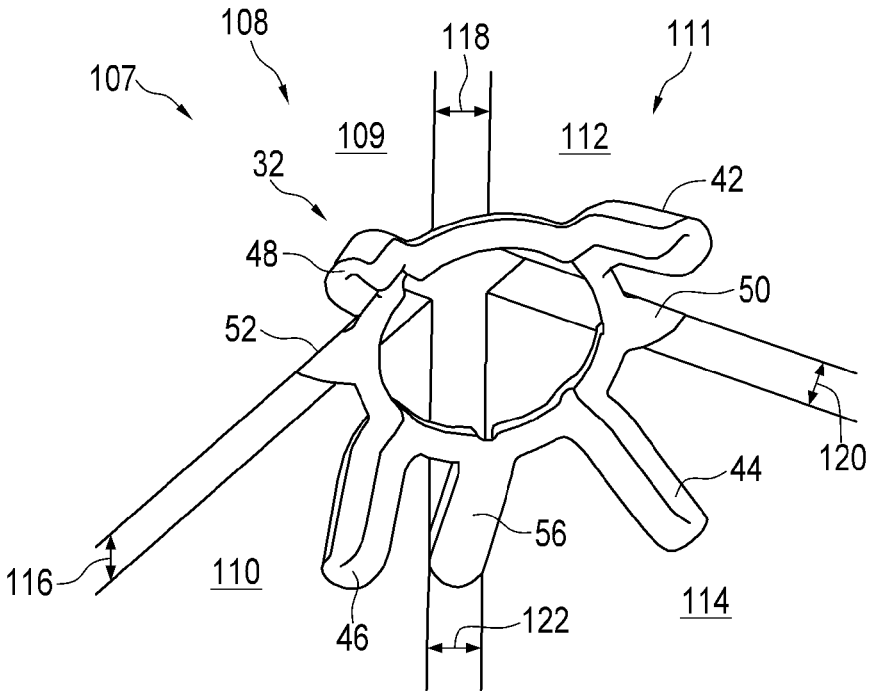
FIG. 11 is an isometric view of the tile spacer of FIG. 2 interposed between tiles in two rows that abut a two-sided corner.
Figure 12:
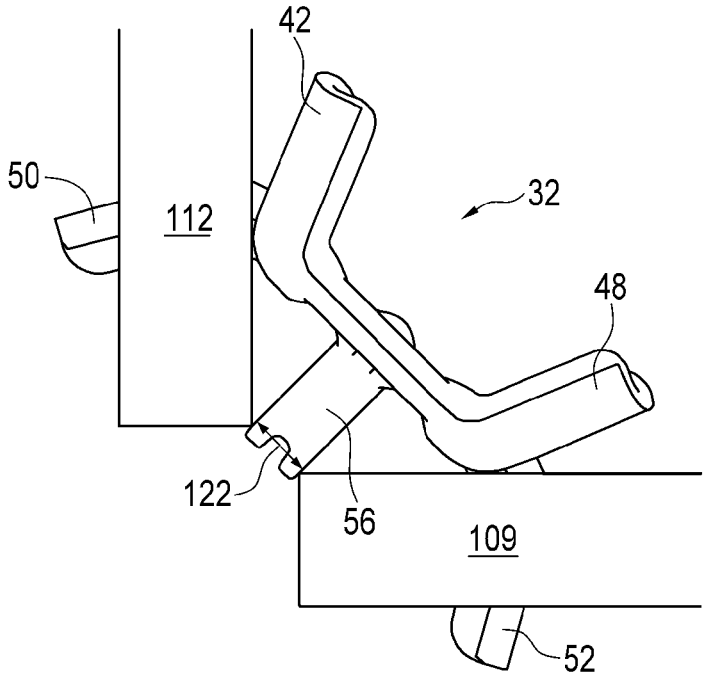
FIG. 12 is a top plan view of the tile spacer and tiles of FIG. 11.

Referring now to FIGS. 11 and 12, the tile spacer 32 is shown between tiles in two rows of tiles that abut a two-sided corner 107, including a first column 108 having a first tile 109 and a second tile 110, and a second column 111 having a third tile 112 and a fourth tile 114. In this example, the second tile 110 and the fourth tile 114 are previously positioned as shown. The tile spacer 32 is then positioned such that the sixth member 52 is between and abuts both the first tile 109 and the second tile 110. The fifth member 50 is positioned between and abuts the third tile 112 and the fourth tile 114. The seventh member 56 is placed between and abuts the second tile 110 and the fourth tile 114. As a result, the tile spacer 32 enables even spacing between the tiles in two rows that abut a two-sided corner 107, forming gaps 116, 120 and 122, which in this example are all of equal width. The first member 42, the second member 44, the third member 46 and the fourth member 48 extend outwards away from the tiles and thereby allow a user to easily grip these members to remove the tile spacer 32 after grouting is complete.

Installation of tiles as illustrated in FIGS. 11 and 12 has significant advantages in setting grout gaps at corners. It is preferable that the horizontal lines formed by any chosen pattern type extend from wall to wall or surface to surface. In most cases, such as shower stalls tiled on three sides or counter tops tiled to back splash tiles, the two or three tiled surfaces will be close to 90 degrees to one another. The tile spacer 32 when installed in such a manner as illustrated in FIGS. 11 and 12 will force alignment of horizontal grout gaps, such as gaps 116 and 120.

Figure 13:
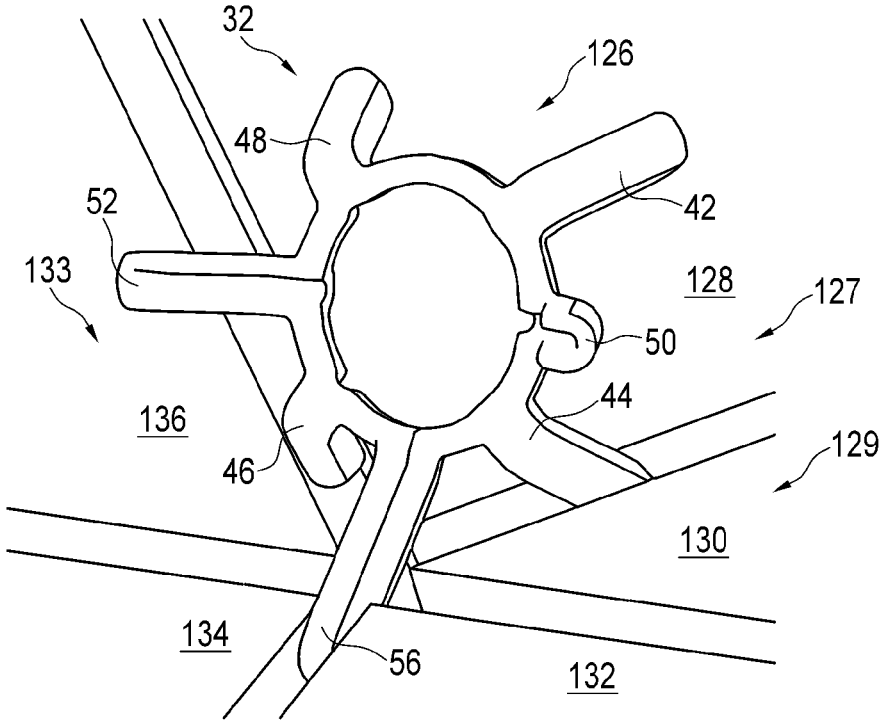
FIG. 13 is an isometric view of the tile spacer of FIG. 2 interposed between tiles arranged in a Y-shape pattern.
Figure 14:
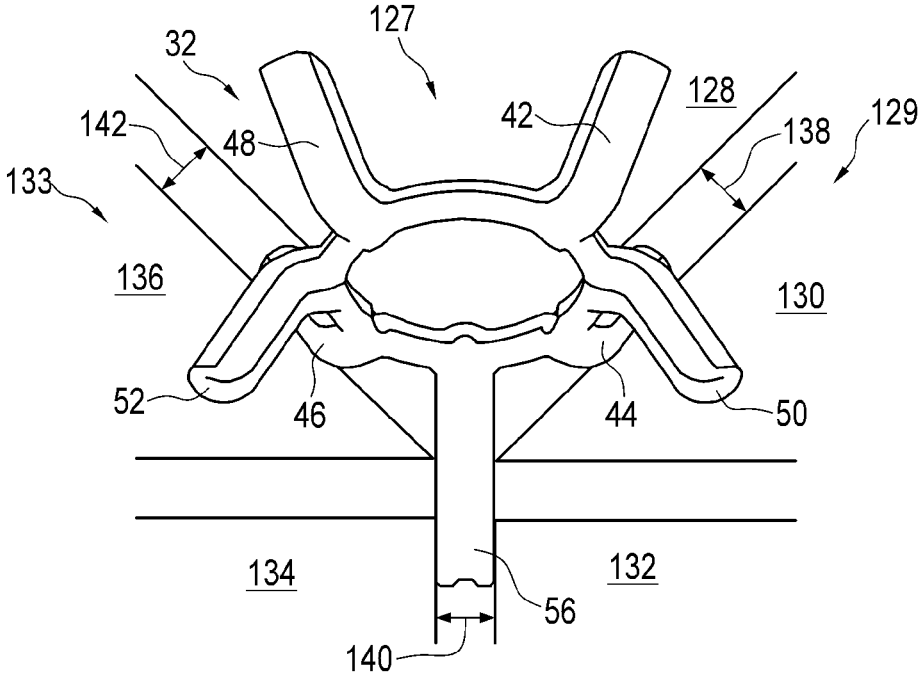
FIG. 14 is a top plan view of the tile spacer and tiles of FIG. 13.

Referring now to FIGS. 13 and 14, the tile spacer 32 is used to position tiles with a Y-shape grout pattern 126. In this example, there is a first set of tiles 127 including a first tile 128. A second set of tiles 129 includes a second tile 130 and a third tile 132. A third set of tiles 133 has a fourth tile 134 and a fifth tile 136. The tile spacer 32 is positioned such that the second member 44 is interposed between and abuts both the first tile 128 and the second tile 130. The seventh member 56 is interposed between and abuts both the third tile 132 and the fourth tile 134. The seventh member 56 may also abut both the second tile 130 and the fifth tile 136. The third member 46 is interposed between and abuts both the fifth tile 136 and the first tile 128. Accordingly, the tile spacer 32 enables even spacing between tiles requiring a Y-shape grout pattern through gaps 138, 140, and 142, which in this example are all of equal width. The first member 42, the fourth member 48, the fifth member 50 and the sixth member 52 are all spaced-apart from the tiles and therefore allow a user to easily grip these members to remove the tile spacer 32 after grouting is complete.

Figure 15:
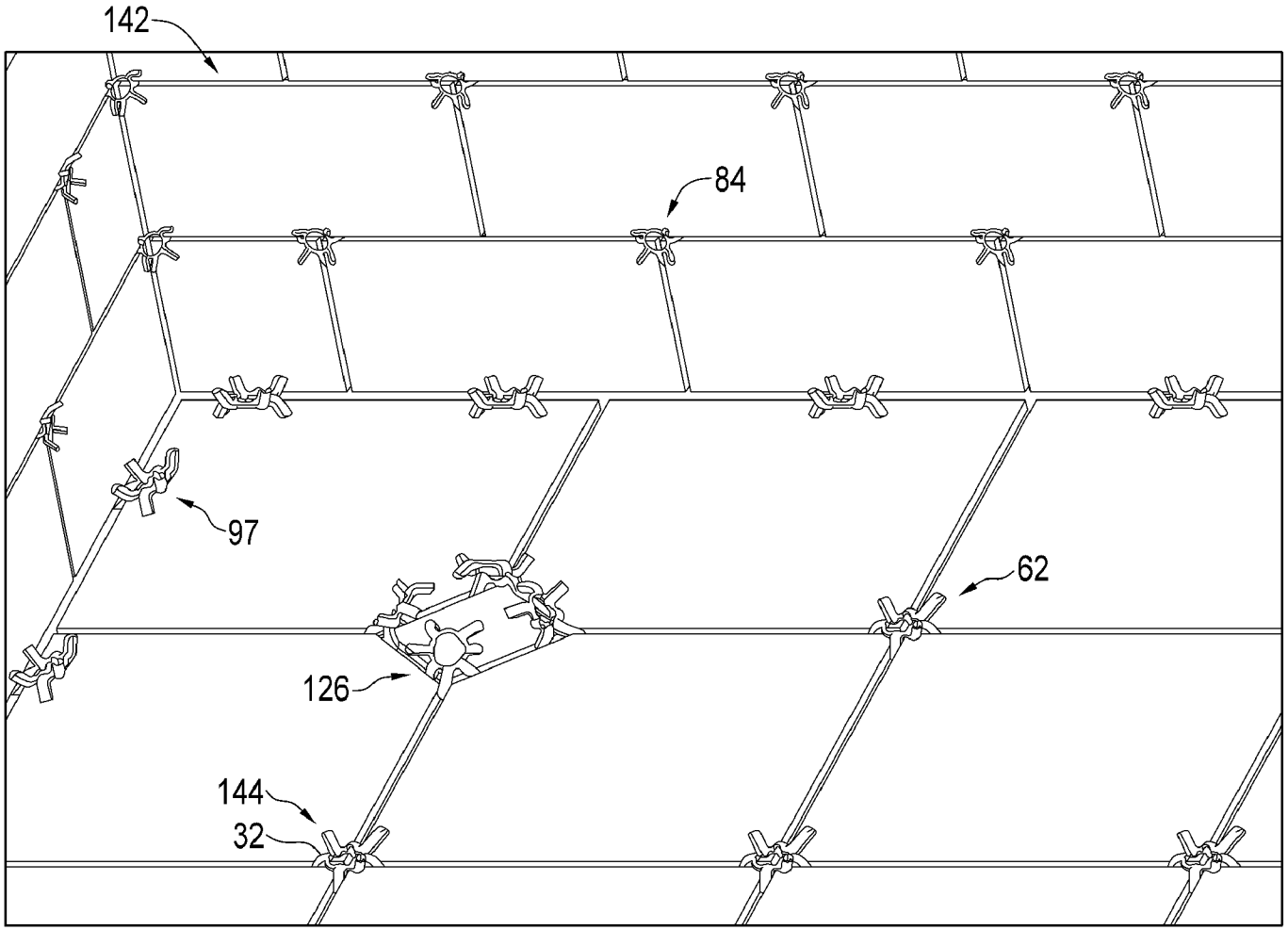
FIG. 15 is an isometric view of a plurality of the tiles spacers of FIG. 2 interposed between a plurality of tiles.

An illustration of many of the above tile arrangements in combination with a plurality of tile spacers 32 is depicted in FIG. 15, which shows a plurality of tiles 142 that are evenly spaced-apart by the plurality of tile spacers 144 as exampled by tile spacer 32. Tiles of various arrangement patterns include four tiles requiring a cross-shape grout pattern 62, three tiles requiring a T-shape grout pattern 84, two tiles at a two-sided corner 97, and tiles requiring a Y-shape grout pattern 126.

Figure 16:
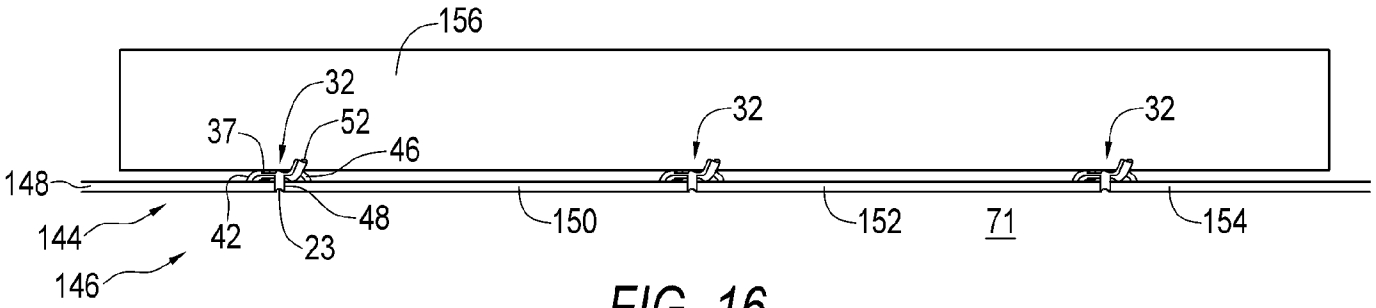
FIG. 16 is a front elevation view of three of the tile spacers of FIG. 2 supporting an elongated ruler.
Figure 17:
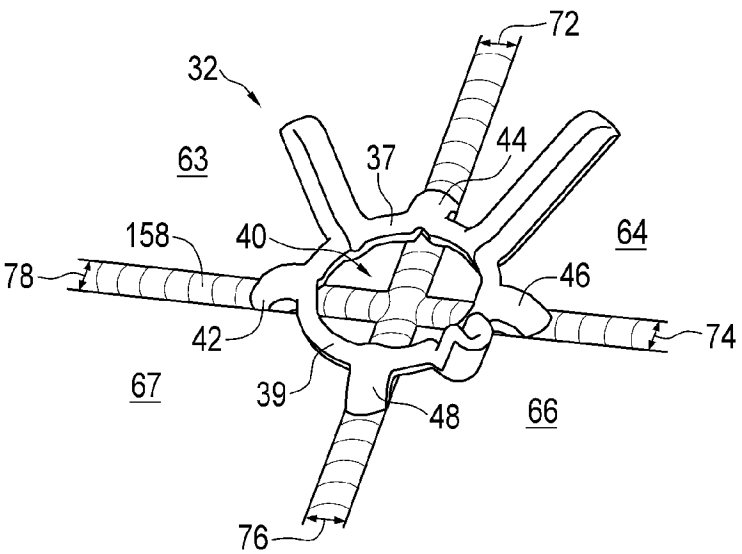
FIG. 17 is an isometric view similar to FIG. 3 with grouting applied between the tiles.

Referring now to FIG. 16, a straight edge such as a ruler 156 is shown placed upon a plurality of the tile spacers 144 interposed between tiles 148, 150, 152, and 154. In this example, for each tile spacer 32 the ruler 156 abuts the body 37 and is interposed between the sixth member 52 and the seventh member 56 (shown in FIG. 2). The tile spacers thereby support the ruler 156 which is then used to gauge whether the tiles 148, 150, 152 and 154 are on an even plane. Put another away, the ruler 156 is placed across the tops of annular bodies 37 which thereby provide the user with a parallel reference surface line or edge.

This methodology helps the user to quickly spot unevenness from tile to tile or in an overall area. Where a substrate 71 is uneven, the tile spacers aid in identifying a non-parallel sight line that is appropriate in that area and help the user to vary the tile setting height. This will thereby result in a smoothing out of substrate anomalies to convey the overall impression of flatness in the finished surface. The user may decide on two tiles spacers that are determined to be at the correct level and use these to span anomalous substrate areas with the straight edge and quickly spot unevenness from tile to tile or in an overall area.

Figure 18:
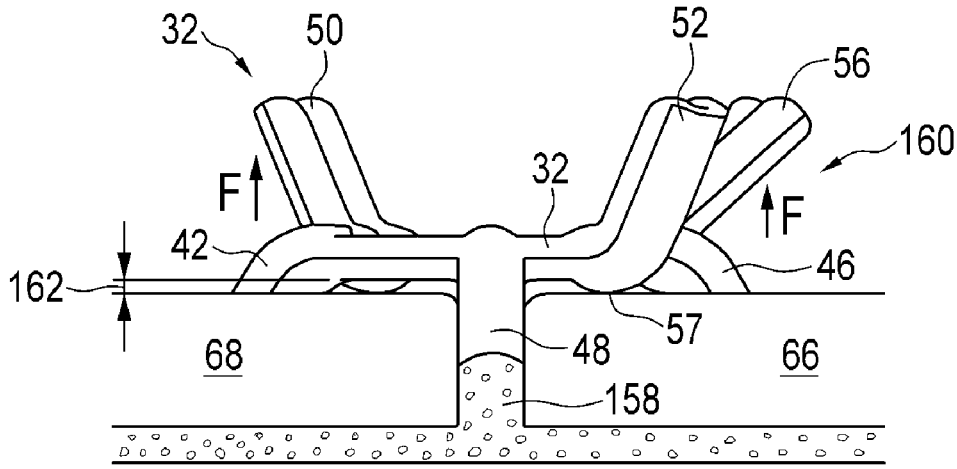
FIG. 18 is a front elevation view of the tile spacer and tiles of FIG. 17.

The application of adhesive 158 to tiles which are spaced-apart by a spacer 32 is shown in FIG. 18. When tiles slide in place there is an adhesive build-up in gaps 72, 74, 76, and 78. Because of the open nature of the tile spacer 32, which includes annular body 37, the tile spacer 32 of the present invention provides the important advantage to the user of clear visibility and identification of any excess adhesive, which is aesthetically and functionally undesirable. Cleaning excess adhesive off the plurality of elongate members of the spacer is extremely easy due to the flexibility of the plurality of elongate members 38.

The elongate members have small cross-sections and this therefore minimizes contact between the adhesive 158 and tile spacer 32. As a result, cleaning excess tile adhesive from the plurality of elongate members is rendered even easier. Also, the small cross-section of the elongate members allows them to easily penetrate the adhesive 158 and contact the firm substrate wood or concrete material. There is a significant benefit to this especially if the substrate is even, true and flat. As a consequence, the annular body 37 acts as a visual cue for the user to gauge the distance from substrate surface to tile surface. Unevenness from tile to tile or in an overall area can quickly be spotted and rectified.

The body 37 remains elevated above the tiles by ridges as exampled by ridge 69 of the first member 42, as illustrated for example in FIG. 4. This provides the user further enhanced visibility of any contamination problem in advance of the adhesive setting. An additional beneficial effect of the body not contacting tops faces of tiles is that hand made, quarry stone, slate, bevel edge and subway tiles, all of which have unpredictable or angled top faces, are readily accommodated by the tile spacer 32 of the present invention.

Referring now to FIG. 18, when the adhesive 158 is sufficiently set, the tile spacer 32 may be readily removed. This is because the tile spacer 32 of the present invention provides the further advantage of having an overall height that extends above the tile line. In this example, the tile spacer 32 is removed by applying a force F upon the tile spacer 32 at the fifth member 50, the sixth member 52 and/or the seventh member 56.

Because of the extremely low surface contact area of the tile spacer 32 with the adhesive 158, the removal task is made extremely simple with the use of non-specialized, commonly available hand tools. A simple stiff brush, spade, trowel, foot, hand or other means will quickly and simply dislodge the tile spacer 32 through force F.

As a result of the structure of the present invention and in summary, it will be clear to those skilled the art that the present invention results a tile spacer 32 for aligning, spacing and positioning tiles in of a wide variety of tile patterns, and that moreover is reusable, easy to handle, quickly removed, and that provides visual access to the intersecting tile corners.

One skilled in the art will appreciate that many variations fall within the subject matter of the present invention. For example, the tile spacer may be made of metal. This would provide the tile spacer with the advantages of being more durable and less prone to damage. Also, the tile spacer with such a shape allows for different manufacturing methods like die casting or investment casting. If the tile spacer is made of ferromagnetic material, a strong magnet could be used to remove the spacer.

Figure 19:
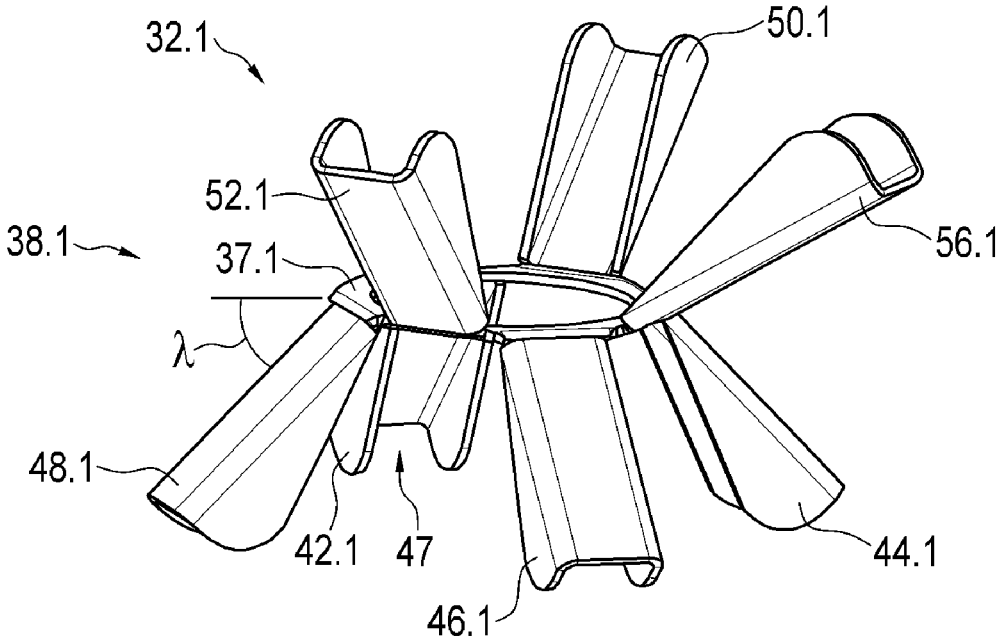
FIG. 19 is an isometric view of another embodiment of a removable tile spacer.

One variation is illustrated in FIG. 19, which illustrates another embodiment of the tile spacer according to the present invention. FIG. 19 is similar to FIG. 2 with like features having like numerals with the addition of ".1". The tile spacer 32.1 in this example is made sheet metal. The tile spacer 32.1 has square groves 47. This allows for a simple manufacturing method while still providing necessary robustness. Sheet metal allows the user to adjust the angle λ for each of the plurality of elongate members 38.1 as the user sees fit for a particular installation requirement.

The tile spacer 32.1 has square groves 47. This allows for a simple manufacturing method while still providing necessary robustness. Sheet metal allows the user to adjust the angle λ for each of the plurality of elongate members 38.1 as the user sees fit for a particular installation requirement.

Figure 20:
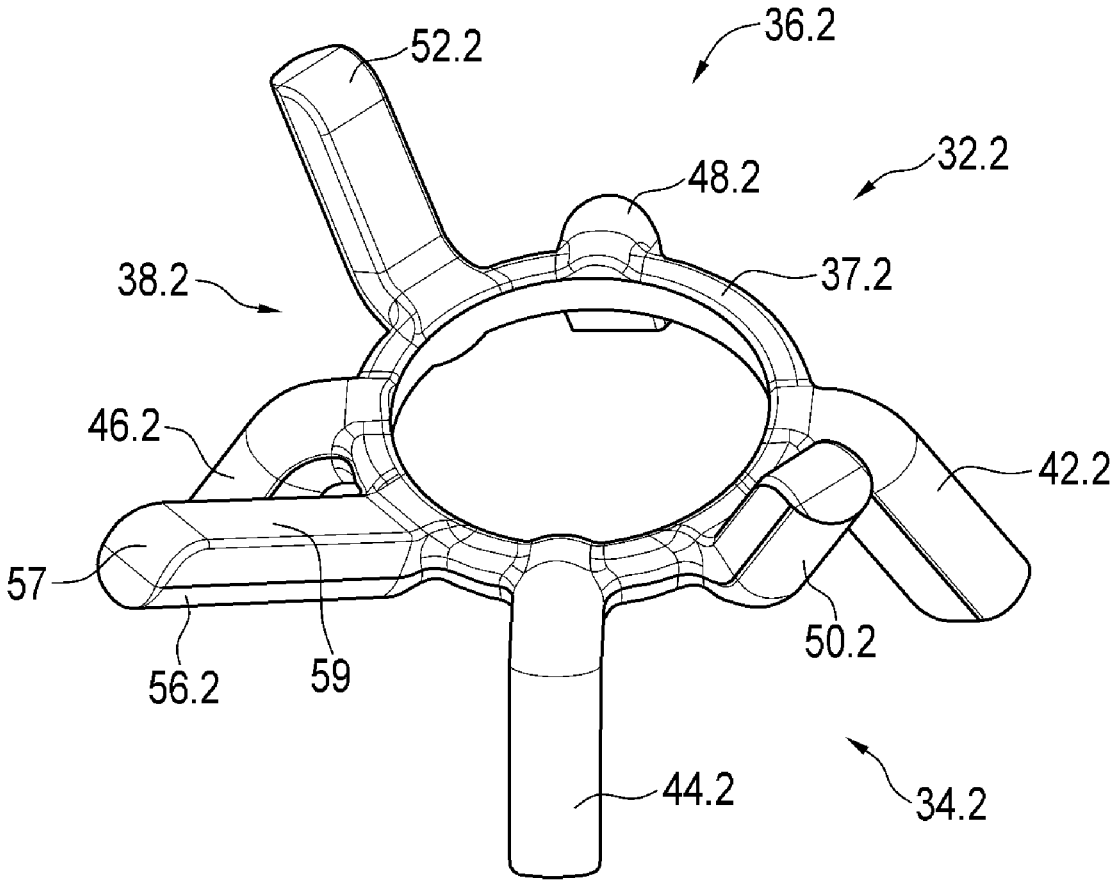
FIG. 20 is an isometric view of a further embodiment of a removable tile spacer.

A further variation is illustrated in FIG. 20, which illustrates another embodiment of the tile spacer according to the present invention. The embodiment of FIG. 20 is similar to the embodiment of FIG. 2 with like features having like numerals with the addition of ".2". The tile spacer 32.2 has elongate members that are each continuous through their cross-sections. Each elongate member has a flat portion 59 extending outwards from the body 37.2 and a partially rounded end 57 as shown by elongate member 56.2. In this example, for each elongate member, the flat portion at least partially faces the same side to which the elongate member extends. Only elongate member 56.2 is discussed with the understanding that the other elongate members bear a similar structure and function. Thus flat portion 59 of elongate member 56.2 at least partially faces the second side 36.2 of the tile spacer 32.2.

When the tile spacer 32.2 is used in a butt joint configuration similar to that shown in FIGS. 9 and 10, the flat portions of elongate members may abut against the end 199 of the second tile 196. These flat portions may thus add more stability to the tile spacer so disposed in the butt joint configuration and thus inhibit movement of the tiles so positioned.

Similar stability advantages may result when the tile spacer 32.2 with its flat portion is interposed between two tiles adjacent to a two-sided corner similar to FIGS. 7 and 8.

Also the tile spacer 32.2 may be advantageously less expensive to manufacture since the channel-shape feature of the elongate members is removed.

Referring back to FIG. 20, those skilled in the art will appreciate that the flat portions as shown by flat portion 59 may alternatively be disposed to at least partially face the first side 34.2 of the tile spacer 32.2. In a further alternative, one or more elongate members may have two flat portions opposite to and in parallel with each other, in order to further promote stability for the tile spacer uses, for example, similar to those shown in FIGS. 7 to 10.

For the tile spacer interposed between two tiles at a two-sided corner as illustrated in FIGS. 7 and 8, those skilled in the art will appreciate that only the seventh member 56 and one projection portion is needed. The projection portion, for example, need only be one member from the group of the following elongate members: the second member 44, the third member 46, the fifth member 50 and the sixth member 52.

For the tile spacer interposed between two tiles positioned in a butt joint configuration, those skilled in the art will appreciate that, in the alternative, the second tile 196 via its end 199 may be positioned to abut both the wall 191 and the floor 189. The first tile 192 may be positioned to abut the floor 189 only, with its end 195 facing the second side 198 of the second tile 196. In this configuration the tile spacer 32 may be interposed between the second side 198 of the second tile 196 and the end 195 of the first tile 192, in an analogous manner to that described for FIGS. 9 and 10. Alternatively, the tiles may be positioned in a butt joint configuration where the tiles both overlay/abut adjacent walls (instead of a wall/floor situation).

For the tiles requiring a Y-shaped grout pattern and referring to FIGS. 13 and 14, those skilled in the art will appreciate that a single, whole tile could take the place of the second tile 130 and the third tile 132, and that a single, whole tile could take the place of the fourth tile 134 and the fifth tile 136.

The tile spacer 32 used for the tiles requiring a Y-shape grout pattern, as illustrated in FIGS. 13 to 14, may similarly be used in conjunction with a hexagonal-shaped tile setting.

Those skilled in the art will appreciate that the tile spacer may be used in conjunction with tiles made from a wide spectrum of different materials, including glass, clay, natural stone, ceramic or metal.

Figure 21:
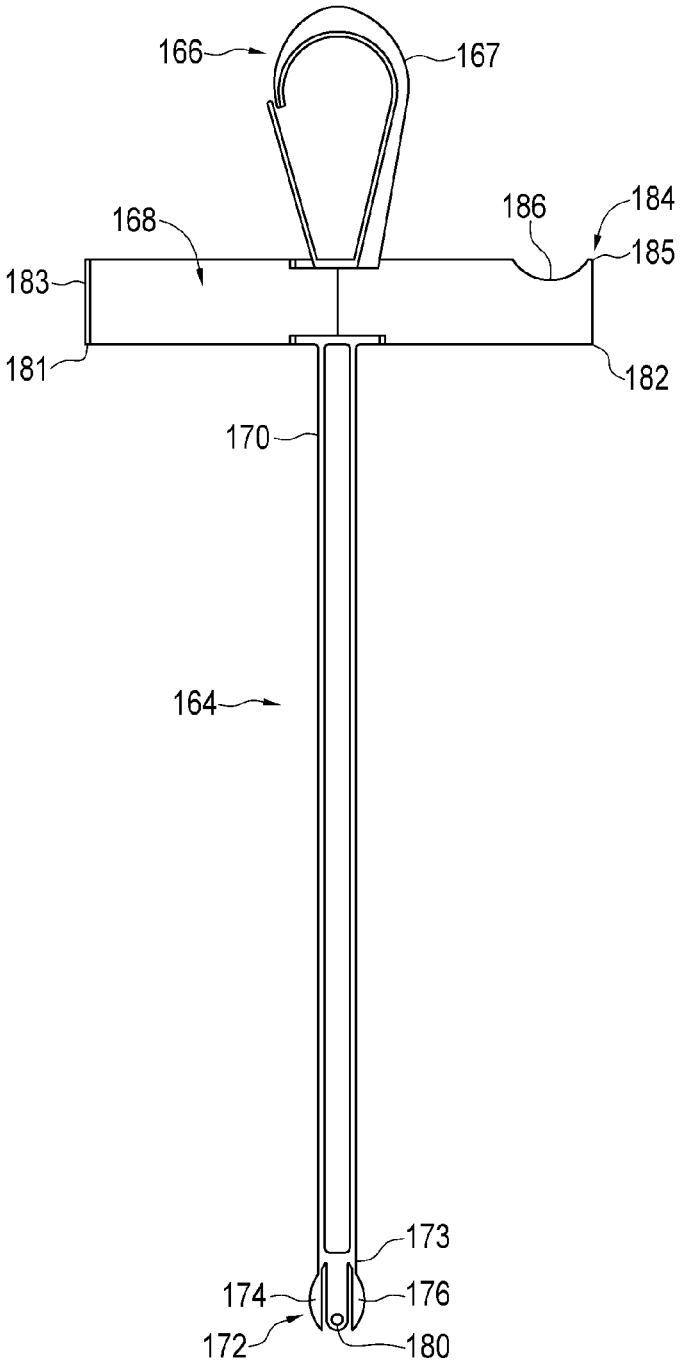
FIG. 21 is a front elevation view of a multipurpose tile spacer dispenser and tiling tool.

A further aspect of the invention will now be described in FIGS. 21 to 24. Referring to FIG. 21, a tiling tool 164 for storing and dispensing a stack 162 of tile spacers is illustrated. The tiling tool 164 has a first end 166 with a clip 167. The clip 167 may attach to rope or a user's belt or the like. The tiling tool 164 has a handle 168 with a first end 181 and a second end 182. A squeegee 183 extends from the first end 181. An inwardly extending recess 186 is located adjacent to the second end 182. A chisel 184 is located at the second end 182. In a preferred embodiment, the chisel 184 is formed from a hard material to thereby provide the chisel 184 with a harder edge 185. A rod 170 extends from the handle 168.

A dispenser 172 extends from the rod 170 at a distal end 173. The dispenser 172 in this example comprises a central portion 180 interposed between resilient members 174 and 176, which are generally D-shaped members in this example. The resilient members 174 and 176 are inwardly compressible towards the central portion 180.

Figure 22:
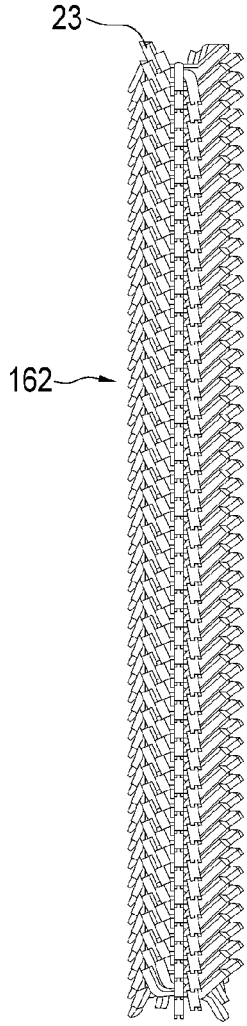
FIG. 22 is a front elevation view of a plurality of the tile spacers of FIG. 2 stacked together.

Referring now to FIG. 22, a stack of tile spacers 162 is illustrated. Each tile spacer 32 is so shaped as to allow a compact stacking of a plurality of tile spacers 162. One example of such stacking is interposing the plurality of elongate members extending to the first side from one tile spacer with the plurality of elongate members extending to the second side of another tile spacer.

Figure 23:
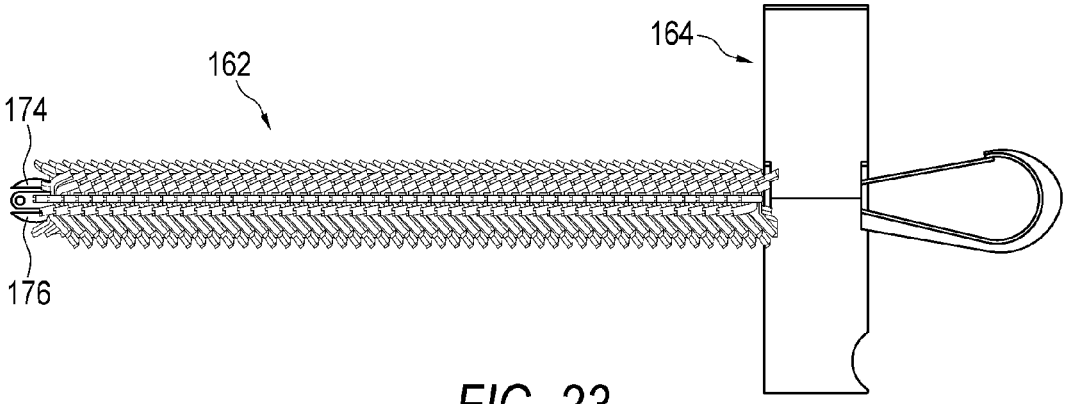
FIG. 23 is a side elevation view of the multipurpose tile spacer dispenser and tiling tool of FIG. 21 engaging the plurality of stacked tile spacers of FIG. 22.
Figure 24:
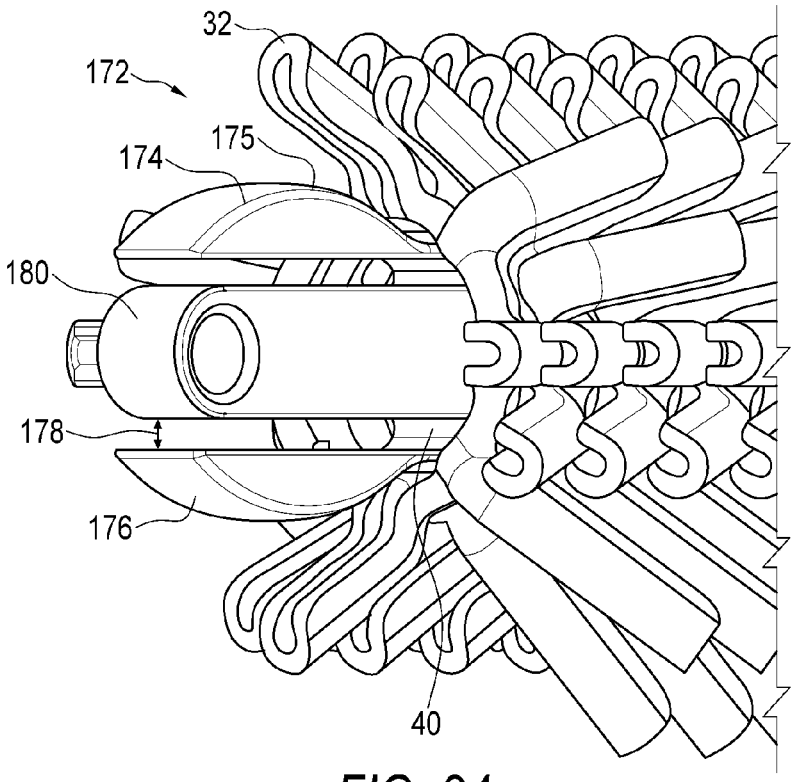
FIG. 24 is an isometric, partial view of FIG. 23 illustrating a dispenser at a distal end of the multipurpose tile spacer dispenser and tiling tool.

The rod 170 extends through apertures 40 of the tile spacers as shown in FIGS. 23 and 24. In the position shown in FIG. 24, the resilient members 174 and 176 inhibit a tile spacer from being removed from the tiling tool 164. When the resilient members 174 and 176 are compressed together, the tile spacers 32 may pass over them. In this way the user may selectively remove tile spacers as required.

This is advantageous because when tiling the user can systematically work in rows or columns away from a reference point, feature or predefined line. The dispenser 172 offers a convenient method of hands-free organization and conveyance of tile spacers when clipped to tool belt or coverall strap. In vertical tiling applications, the dispenser 172 may be attached by clip 167 to a nail or hook in a nearby location. This results in a ready supply of spacers being accessible to the user.

A further advantage of the dispenser 172 is that it enables the user to hold single items or multiple quantities using one hand. Once the adhesive is cured and the tile spacers are removed by previously discussed means, the dispenser 172 may be reloaded and reused.

The tiling tool 164 provides further advantages in the form of its variety of added features. The squeegee 183, which extends from end 181 of the handle 168, may be used to clean, spread and manipulate adhesive material. The squeegee may be used to pre-apply the adhesive to the bottom side of a tile in specific cases. The opposite, second end 182 of the handle 168 forms the chisel 184 which provides the benefit of being insertable into small gaps between the tiles to help manipulate or move the tiles before adhesion takes place. The recess 186 adjacent to the chisel may be used as a scooping device for cleaning excess adhesive material from the adhesive grout gaps.

Those skilled in the art will appreciate that many variations are possible for the tiling tool 164. For example, there need only be one resilient member at the distal end 173 of the dispenser 172 used in conjunction with the central portion 180. Alternatively, there may simply be two resilient members without the need of the central portion.

It will be understood by someone skilled in the art that many of the details provided above are by way of example only and are not intended to limit the scope of the invention which is to be determined with reference to the following claims.

What is claimed:

1. A removable tile spacer for enabling even spacing between a first tile and a second tile, the first tile and the second tile being perpendicular to each other, the second tile having an end opposite the first tile, the removable tile spacer comprising:

a first elongate member interposable between the first tile and the end of the second tile to provide spacing between the first tile and the second tile;

a body, the first elongate member being connected to and extending away from the body at an angle relative to the body such that the body has at least a portion which is spaced-apart from both the first tile and the second tile when the first elongate member is interposed between the first tile and the end of the second tile, thereby facilitating removal of the tile spacer when tile spacing is completed; and a second elongate member connected to and extending away from the body, the second elongate member being spaced-apart from the first elongate member and positioned to be interposable between the first tile and the second tile together with the first elongate member to provide even spacing between the first tile and the second tile.

2. The tile spacer as claimed in claim 1 wherein the first elongate member and the second elongate member extend radially away from the body at a non-perpendicular angle relative to the body.

3. The tile spacer as claimed in claim 2 wherein the body is annular.

4. The tile spacer as claimed in claim 3 further including a third elongate member connected to and extending away from the body, the third elongate member disposed to abut against one of the first tile or the second tile when the first elongate member and the second elongate member are interposed between the first tile and the second tile.

5. The tile spacer as claimed in claim 3 further including a third elongate member connected to and extending radially away from the body, the third elongate member disposed to abut against the second tile when the first elongate member and the second elongate member are interposed between the first tile and the second tile.

6. The tile spacer as claimed in claim 2, wherein the tile spacer has a first side and a second side, the tile spacer further including a third elongate member connected to and extending radially away from the body, the first elongate member and the second elongate member extending towards the first side, the third elongate member extending towards the second side and being spaced-apart from both the first tile and the second tile when the first elongate member and the second elongate member are interposed between the first tile and the end of the second tile, the third elongate member thereby facilitating removal of the tile spacer when tile spacing is completed.

7. The tile spacer as claimed in claim 1 wherein the first elongate member and the second elongate member have a u-shaped cross-section.

8. The tile spacer as claimed in claim 1, wherein the first elongate member has a first side for abutting the first tile and a second side opposite the first side for abutting the end of the second tile, the first side being disposable in parallel with the first tile and the second side being disposable in parallel with the end of the second tile.

9. The tile spacer as claimed in claim 1, wherein the first elongate member has at least one flat portion for abutting at least one of the first tile or the end of the second tile when interposed therebetween.

10. The tile spacer as claimed in claim 1 wherein the first elongate member has a first side for abutting the first tile and a second side opposite the first side for abutting the end of the second tile, and the second elongate member has a first side for abutting the first tile and a second side opposite the first side for abutting the end of the second tile.

11. The tile spacer as claimed in claim 10 wherein the first elongate member is shaped to have its first side interposable in parallel with the first tile and its second side interposable in parallel with the end of the second tile and the second elongate member is shaped to have its first side interposable in parallel with the first tile and its second side interposable in parallel with the end of the second tile.

12. The tile spacer as claimed in claim 1 wherein the first elongate member has at least one flat portion for abutting at least one of the first tile and the end of the second tile when interposed therebetween and the second elongate member has at least one flat portion for abutting at least one of the first tile and the end of the second tile when interposed therebetween.

13. In combination, a first tile and a second tile having an end opposite the first tile, the first tile and the second tile being arranged perpendicular to each other, and a removable tile spacer for enabling even spacing between the first tile and the second tile, the removable tile spacer comprising:

a first elongate member interposable between the first tile and the end of the second tile to provide spacing between the first tile and the second tile;

a body, the first elongate member being connected to and extending away from the body at an angle relative to the body such that the body has at least a portion which is spaced-apart from both the first tile and the second tile when the first elongate member is interposed between the first tile and the end of the second tile, thereby facilitating removal of the tile spacer when tile spacing is completed; and a second elongate member connected to and extending away from the body, the second elongate member being spaced-apart from the first elongate member and interposable between the first tile and the second tile together with the first elongate member to provide even spacing between the first tile and the second tile thereby.

14. The combination as claimed in claim 13 wherein the body of the tile spacer is annular.

15. The combination as claimed in claim 14 wherein the first elongate member and the second elongate member extend radially away from the body of the tile spacer at a non-perpendicular angle relative to the body.

16. A method of arranging a first tile and a second tile in a butt joint configuration, using a removable tile spacer having a body, a first elongate member connected to and extending away from the body at an angle and a second elongate member connected to and extending away from the body, the second elongate member being spaced-apart from and adjacent to the first elongate member, the method comprising:

laying down the first tile on one of a first surface and a second surface and against a corner made by the first surface and the second surface;

positioning the second tile against the other of the first surface and the second surface, the second tile having an end facing the first tile;

interposing the first elongate member between the first tile and the end of the second tile to provide spacing between the first tile and the second tile; and interposing the second elongate member between the first tile and the end of the second tile to provide even spacing between the first tile and the second tile thereby.

17. A removable tile spacer for enabling even spacing between a first tile and a second tile, the first tile and the second tile being perpendicular to each other, the first tile having a tile face and the second tile having an end opposite the tile face, the removable tile spacer comprising:

a body having an annular shape; and a first elongate member and a second elongate member, both members being connected to and radially extending away from the body, the first elongate member and the second elongate member being spaced-apart from each other and being arranged to simultaneously abut between both the tile face of the first tile and the end of the second tile to provide even spacing between the first tile and the second tile.

* * * * *